US005486660A

United States Patent [19]

Fasano

[11] Patent Number: 5,486,660

[45] Date of Patent: Jan. 23, 1996

[54] RESET ONLY ROCKER GUARD FOR SPLIT CASE CIRCUIT BREAKER

[75] Inventor: Michael Fasano, Watertown, Conn.

[73] Assignee: Carlingswitch, Inc., Plainville, Conn.

[21] Appl. No.: 259,864

[22] Filed: Jun. 15, 1994

[51] Int. Cl.[6] ..... H01H 9/28

[52] U.S. Cl. ..... 200/43.16; 200/401; 200/43.19; 200/303

[58] Field of Search ..... 200/401, 43.11, 200/43.13, 43.14, 43.15, 43.16, 43.19, 333, 339, 303, 553, 554, 555, 556, 557, 558, 293

[56] References Cited

U.S. PATENT DOCUMENTS 4,347,488 8/1982 Mune et al. ..... 375/8
4,623,861 11/1986 Krosij et al. ..... 206/339
4,978,816 12/1990 Costonguay et al. ..... 200/43.14
5,113,043 5/1992 Morris ..... 200/43.14

*Primary Examiner*—Henry J. Recla
*Assistant Examiner*—David J. Walezak
*Attorney, Agent, or Firm*—McCormick, Paulding & Huber

[57] ABSTRACT

A split case magnetic circuit breaker has a bracket secured to the front of the breaker housing similar to that used to provide a rocker for operating the breaker manually and for resetting the breaker when tripped. The bracket is formed with a small access window so that the rocker can be reset, but cannot be manually switched off.

4 Claims, 3 Drawing Sheets

RESET ONLY ROCKER GUARD FOR SPLIT CASE CIRCUIT BREAKER

The present invention relates generally to rocker actuated circuit breakers having a bracket assembly mounted to the breaker for providing ON and OFF movement of the breaker mechanism. The invention deals more particularly with an improved bracket assembly for such a rocker actuated breaker wherein the bracket assembly defines a guard designed to restrict manual rocker movement toward OFF and to nevertheless allow rocker movement toward reset or ON.

SUMMARY OF THE INVENTION

The present invention resides in a rocker actuated circuit breaker of the type that is normally toggle operated, but which can be equipped with a bracket assembly having a rocker provided for moving the breaker mechanism from ON to OFF.

The improvement of the present invention resides in providing the bracket assembly with a guard for the rocker such that the rocker cannot be moved to OFF, but can be moved to reset the breaker, or to turn the breaker ON.

The bracket assembly comprises a molded plastic adapter plate and is resiliently deformable so that rearwardly extending legs at each end of the plate are adapted to engage slots in the ends of the split case circuit breaker. The adapter plate defines a rearwardly open recess of generally rectangular shape for receiving the rocker. The adapter plate has an integrally molded guard that inhibits movement of the rocker except to reset the breaker. The adapter plate defines a window to provide access for manually moving the rocker at least to its ON or reset position. The window is so defined that access to the rocker is not possible for switching the rocker OFF.

The general object of the present invention is to provide an actuator bracket assembly for a split case circuit breaker such that the breaker can be fitted into a rectangular size panel opening and such that the circuit breaker can only be manually actuated to reset the breaker. The rocker cannot be conveniently actuated to OFF. Only with an appropriate tool can the breaker be switched to OFF.

DETAILED DESCRIPTION

Figure 1:
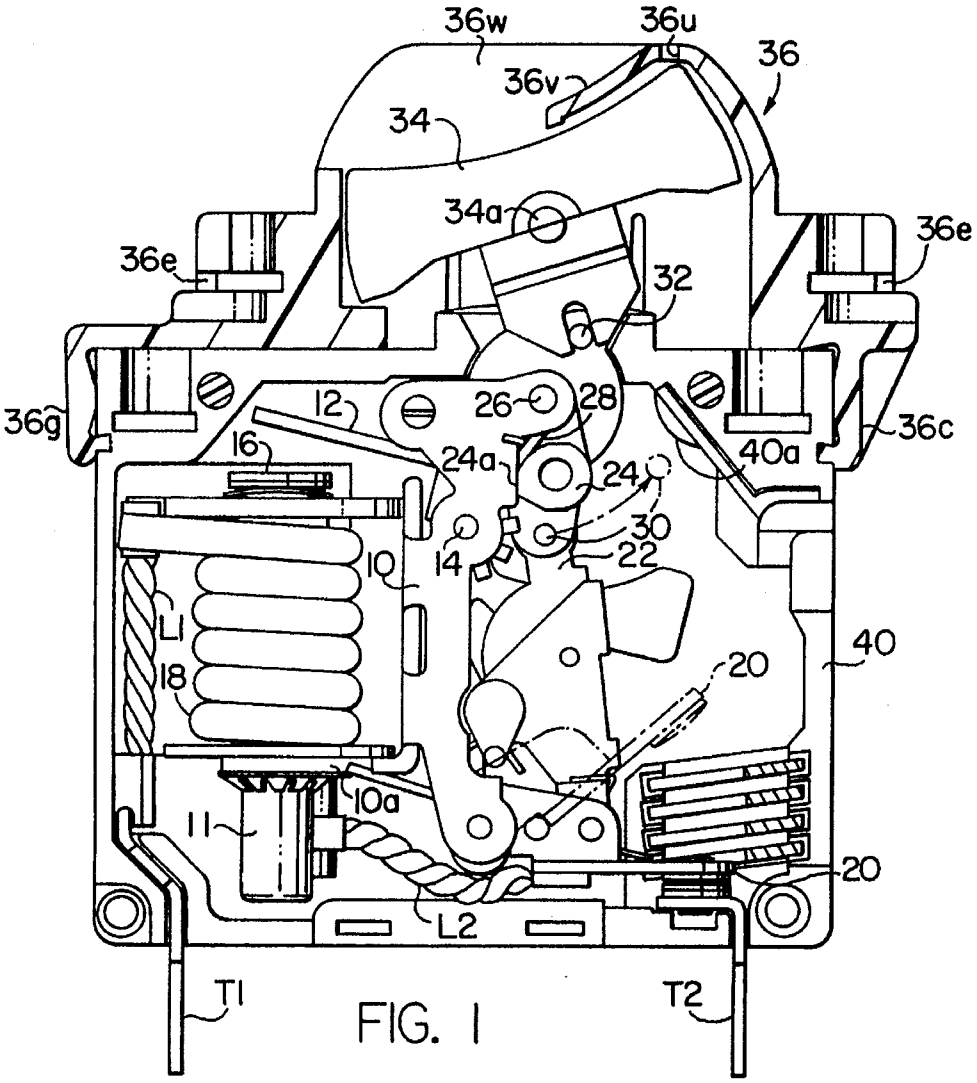
FIG. 1 is an elevational view with portions of the breaker case broken away to illustrate a conventional split case magnetic circuit breaker fitted with a rocker bracket assembly in accordance with the present invention. The breaker mechanism is illustrated in the ON condition and the movable contact is also shown OFF in phantom lines.

Turning now to the drawings in greater detail, FIG. 1 illustrates a magnetic circuit breaker of the type adapted to be fitted in a small circular opening of a panel, such circuit breaker being of the type generally described in prior issued U.S. Pat. No. 4,347,488 entitled "Multi-Pole Circuit Breaker" issued Aug. 31, 1982 and assigned to the assignee herein. The breaker shown in that patent is also referred to in U.S. Pat. No. 4,623,861 issued Nov. 18, 1986 illustrating an alternative bracket assembly suitable for providing a circuit breaker of the type shown in the '488 patent in a relatively larger rectangular panel opening. The bracket assembly of the present invention differs from that shown in the '861 patent in that manual manipulation of the rocker is effectively prevented except when the rocker is to be reset or turned ON.

By way of background the single pole circuit breaker shown in FIG. 1 includes a frame 10, which frame has a generally L-shaped armature member 12 pivotably mounted on a pin 14 provided in the frame, which armature is adapted to move between the position shown in FIG. 1 and a position where the armature contacts a pole piece 16 provided in an electromagnetic coil 18. The coil 18 is supported from the frame's horizontally extending leg 10*a* and includes a delay tube 11 in which a magnetizable core (not shown) is adapted to be moved from a lower position to a raised position for purposes of magnetically energizing the armature 12 to pull it in or downwardly against the pole piece 16 in response to overload currents in a series circuit that includes the terminals T1 and T2 of the breaker. Terminal T1 is preferably connected through a line L1 to one end of the electromagnetic coil 18, and the other end of the coil wire is connected by line L2 to movable contact member 20.

Figure 2:
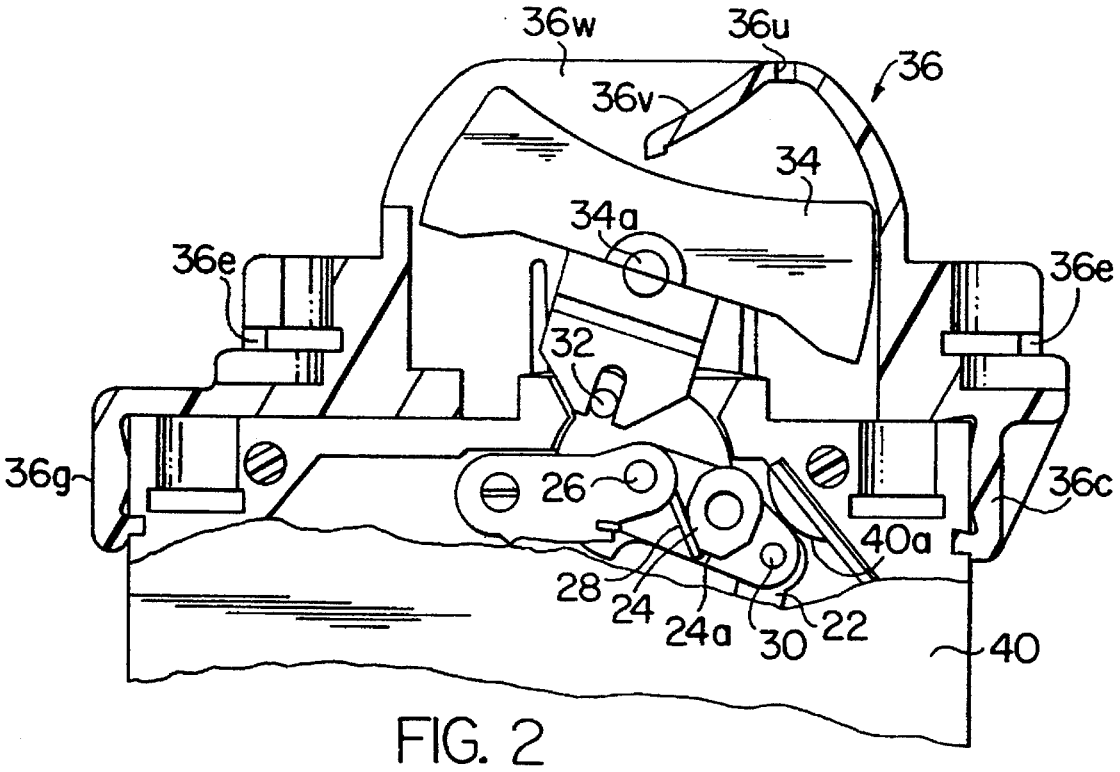
FIG. 2 is a view similar to FIG. 1 but illustrating only the upper end portion of the circuit breaker housing, and with the rocker shown in an alternative position corresponding to that of the tripped or OFF circuit breaker condition.

Still With reference to the conventional circuit breaker mechanism, a collapsible link 22 is provided between this movable contact arm 20 (shown in two alternate positions in FIG. 1) and a pivotably mounted actuator link 24. This link 24 is provided for rotation between the positions shown for it in FIGS. 1 and 2 on a pivot pin 26 mounted in the fixed frame 10. A torsion return spring 28 is provided on the pivot pin 26 for urging the actuator link 24 from the position shown for it in FIG. 1 to that illustrated in FIG. 2. This spring 28 acts between the frame 10 and a boss on the link 24 for this purpose. In FIG. 1, the rocker is ON and the movable contact arm 20 as shown in solid lines at 20 is closed. Actuator link 24 has a portion 24*a* that engages an abutment on the fixed frame 10 so as to define this ON position for both the actuator link 24 and the rocker 34. The OFF position of the rocker and of the actuator link 24 is defined as a result of engagement between the upper end of the collapsible link 22 and the inside of the case as best shown in FIG. 2 at 40*a*.

Figure 3:
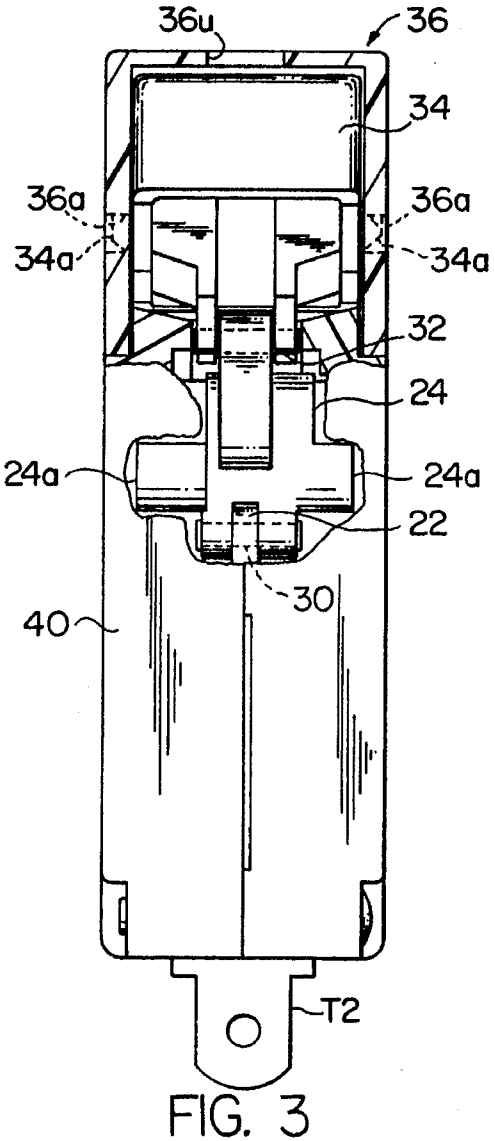
FIG. 3 is an end view of the circuit breaker and rocker bracket assembly illustrated in FIGS. 1 and 2 with portions of the bracket assembly and circuit breaker case broken away.

As best shown in FIG. 3 bosses 24*a*, 24*a* are provided on either side of the actuator link 24 and through opening is provided in these bosses 24*a* for receiving a rod or the like when the single pole circuit breaker shown is adapted to be used in a multi-pole environment. As in the '861 patent referred to previously the link 24 has a lower end defining a cross opening for pivot pin 30, which pin carries one end of the collapsible link 22 referred to previously. FIG. 2 shows the collapsible link 22 with its upper end engaging the abutment 40*a* defined by case 40.

The upper end of the actuator link 24 is disposed in a slot formed in a raised boss on the front face of the circuit breaker housing and carries a cross pin 32 the ends of which cross pin 32 protrude from the sides of the actuator link and are adapted to be engaged by downwardly open slots provided for this purpose in depending portions of the rocker 34. The rocker 34 is formed from a one-piece thermoplastic material, and has laterally projecting axle defining portions 34*a*, 34*a* that are adapted to be received in aligned openings 36*a*, 36*a* provided for this purpose in an adapter plate 36 to be described.

Figure 5:
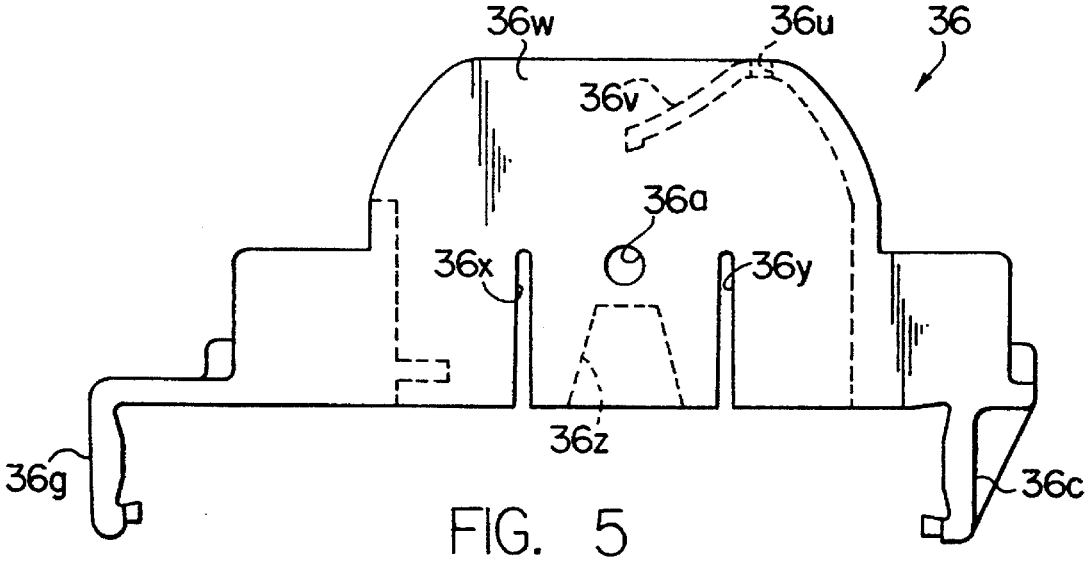
FIG. 5 being a side elevational view of FIG. 4.

As referred to in detail in the '861 patent the adapter plate 36 is secured to openings in the circuit breaker housing opposite end faces by rearwardly or downwardly projecting legs 36*g* and 36*c* so that the bracket plate can be said to have a generally U-shaped configuration that allows it to be integrally molded from a thermoplastic material. Instead of providing at least one of the legs with a reduced cross sectional shape to permit its bending relative to the other leg as in the disclosure of the '861 patent, the present invention instead provides at least one and preferably two slots 36*x* and 36*y* as best shown in FIG. 5 to allow limited but nevertheless necessary movement of the integrally formed leg portions 36*g* and 36*c* with respect to one another. Such movement is required to permit clamping of the bracket plate on the split case circuit breaker housing or case.

Figure 4:
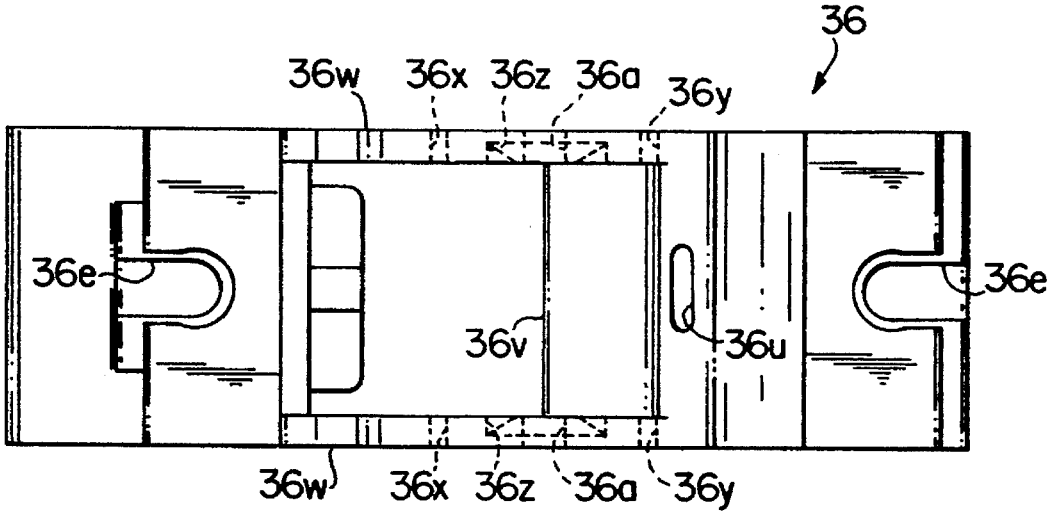
FIG. 4 is a top plan view of the bracket assembly without the rocker and without the breaker.
Figure 6:
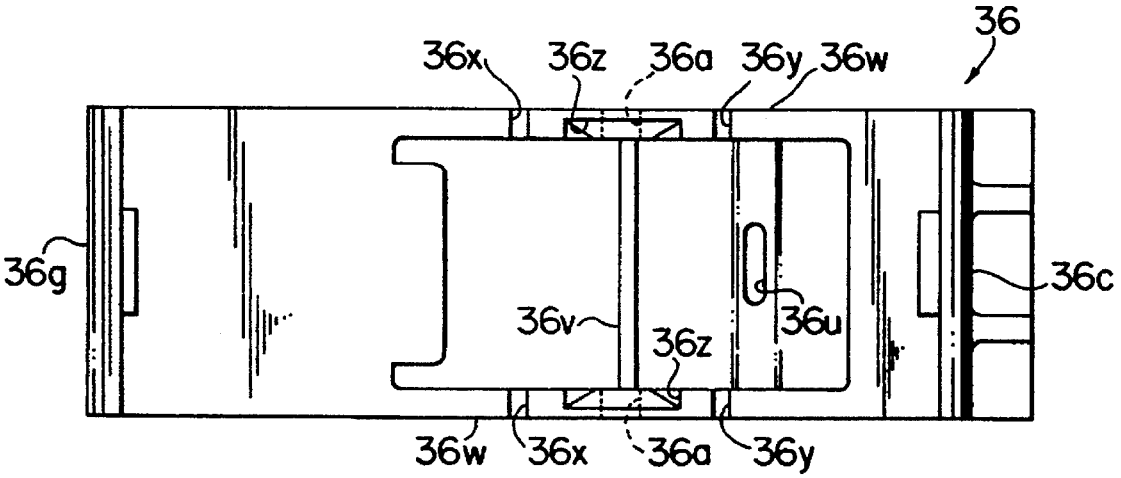
FIG. 6 being a bottom plan view of FIG. 5.

Whereas the above mentioned '861 patent discloses a bracket plate assembly that allows assembly of the rocker from the front of the plate bracket assembly, the present invention contemplates assembly of the rocker with the plate in a preliminary step prior to assembly of the plate with the circuit breaker. Thus, the axle defining portions 34*a*, 34*a* of the rocker are provided in clearance cavities 36*z* of the bracket plate 36 that lead into the openings 36*a* which ultimately receive these axle defining portions 34*a*. FIGS. 4, 5 and 6 best illustrate these downwardly open clearance cavities of the bracket plate provided for receiving the rocker axle portions from underneath the plate rather than from on top of the plate as was true in the disclosure of the '861 patent. In addition to these clearance cavities 36*z*, 36*z* the lower part of the walls 36*w*, 36*w* between the slots 36*x* and 36*y* is resiliently deformable laterally to more readily accommodate the rocker axle portions at assembly.

The rocker 34 is otherwise similar to that described in the prior '861 patent. However, the plate 36 of the present disclosure differs in other respects in addition to those described above by providing only a restricted window for access to the rocker 34. Instead of exposing the entire rocker as was true of the bracket assembly plate in the '861 patent the plate 36 of the present disclosure has upstanding side walls 36*w* which extend well above the rocker 34 as best shown in FIG. 1. Further, a downwardly inclined half wall 36*v* is provided between sidewalls 36*w* to prevent access to that side of the rocker 34 which would otherwise permit movement of the rocker to OFF, corresponding to the circuit breaker open condition This half wall 36*v* has a very small opening 36*u* which does permit access to the rocker 34 with a suitable instrument. However, without access to an instrument that will fit into the small openings 36*u* it will be apparent that the rocker 34 cannot be moved from the position shown for it in FIG. 1 to that of FIG. 2.

The circuit breaker housing itself is identical to that disclosed in the '861 patent and earlier in the '488 patent. The terminals T1 and T2 are conventionally provided in aligned slots provided for them in the half sections or shells of such a split case circuit breaker, and the front face of such a breaker can be seen from FIGS. 1 and 2 to be completely covered by the adapter plate 36 except for the window defined between the walls 36*w* and the half wall 36*v*. Circuit breakers are generally mounted in panels by inserting the front boss of the breaker housing into a panel opening. Threaded inserts are normally provided in recesses of the breaker housing for this purpose. As a result of the bracket assembly disclosed herein means must be provided to secure the bracket assembly of the present invention to such a panel. The plate 36 is provided with end opening recesses 36*e* for mounting threaded metal inserts all as described in greater detail in the prior '861 patent. The inserts preferably have a rectangular base such that they can be conveniently inserted in this manner. This construction provides threaded openings in the inserts whereby conventional fasteners can be provided to mount the circuit breaker and its associated bracket assembly in a conventional rectangular panel opening. The spacing provided between these inserts is suitably chosen so that the circuit breaker and bracket assembly can be fitted in such a panel.

I claim:

1. The combination comprising a rocker actuated circuit breaker and rocker bracket assembly therefor, said circuit breaker comprising a housing having opposite end faces and a front face, said front face having a raised boss adapted to fit a small panel opening, said boss defining a slot, said circuit breaker having a mechanism in the housing including a pivoted actuator link, said pivoted actuator link having a free end portion provided in said slot, said link being pivotably mounted in said housing for limited rotation on a fixed axis defined in the housing, and said link having a cross pin movably mounted in said slot for engaging a rocker, said bracket assembly including a U-shaped adapter plate of one piece plastic with resilient integrally formed leg portions at one end and at an opposite end thereof, said one piece plastic adapter plate having a resilient portion so that said leg portions are moveable with respect to one another in order to receive said circuit breaker front face as a result of bending said plate, said plate leg portions defining inturned lips for entry in openings defined in said circuit breaker end faces, said plate defining a generally rectangular raised boss adapted to fit a larger panel opening than that adapted to accommodate said raised boss of said circuit breaker front face, said plate defining a rearwardly open generally rectangular recess for receiving said rocker, said plate having an integrally molded front wall defining a window for exposing a portion of said rocker, said rocker having a portion accessible through said window for moving said rocker into one position, another portion of said rocker being hidden by said front wall thereby inhibiting movement of the rocker into another position.

2. The combination according to claim 1 wherein said adapter plate has a width corresponding to a width of the circuit breaker housing, and said plate having forwardly projecting side walls defining raised edges for said window.

3. The combination according to claim 2 wherein said plate is resiliently deformable and includes at least two rearwardly open slots defined by the side walls of said integrally formed plate.

4. The combination according to claim 3 wherein said plate includes additional rearwardly open slots to facilitate bending thereof.

* * * * *